US006181307B1

(12) United States Patent
Beeteson et al.

(10) Patent No.: US 6,181,307 B1
(45) Date of Patent: Jan. 30, 2001

(54) PHOTO-CATHODE ELECTRON SOURCE HAVING AN EXTRACTOR GRID

(75) Inventors: John Stuart Beeteson; Andrew Ramsay Knox, both of Ayrshire; Anthony Cyril Lowe, Braishfield, all of (GB)

(73) Assignee: International Business Machines Corporation, Armonk, NY (US)

( * ) Notice: Under 35 U.S.C. 154(b), the term of this patent shall be extended for 0 days.

(21) Appl. No.: 09/118,519

(22) Filed: Jul. 17, 1998

(30) Foreign Application Priority Data

Jan. 21, 1998 (GB) ..... 9801242

(51) Int. Cl.[7] ..... G09G 3/22

(52) U.S. Cl. ..... 345/74.1; 345/86; 313/542

(58) Field of Search ..... 345/74.1–76, 86, 345/102, 106, 107, 111, 21; 313/373–376, 530, 542, 293; 257/527, 530

(56) References Cited

U.S. PATENT DOCUMENTS

| | | | | |
|---|---|---|---|---|
| 3,885,187 | | 5/1975 | Schnitzler | 313/368 |
| 5,395,738 | * | 3/1995 | Brandes et al. | 430/296 |
| 5,461,280 | | 10/1995 | Kane | 313/531 |
| 5,591,986 | * | 1/1997 | Niigaki et al. | 257/10 |
| 6,002,207 | * | 12/1999 | Beeteson et al. | 313/542 |

FOREIGN PATENT DOCUMENTS

| | | |
|---|---|---|
| 0 642 147 | 3/1995 | (EP) . |
| 0 718 865 | 6/1996 | (EP) . |
| 2 171 553 | 8/1986 | (GB) . |
| 2 211 983 | 7/1989 | (GB) . |
| 2 304 981 | 3/1997 | (GB) . |
| 2 304 985 | 3/1997 | (GB) . |
| 2304981 | 3/1997 | (GB) . |
| 2313703 | 12/1997 | (GB) . |
| 5-299040 | 12/1993 | (JP) . |
| 9-63517 | 7/1997 | (JP) . |
| 10-92349 | 10/1998 | (JP) . |

* cited by examiner

*Primary Examiner*—Amare Mengistu
*Assistant Examiner*—Jimmy H. Nguyen
(74) *Attorney, Agent, or Firm*—Scully, Scott, Murphy & Presser; Marian Underweiser, Esq.

(57) ABSTRACT

A photo-cathode electron source suitable for use in flat panel displays has an extractor grid means (104) maintained, in use, at a positive potential with respect to the photo-cathode surface. The extractor grid may be used as a carrier for unfired photoemissive material which forms the emission surface of the photo-cathode. The material is deposited on the surface (103) of the photo-cathode means (102) by means of evaporation from the extractor grid (104).

5 Claims, 4 Drawing Sheets

PHOTO-CATHODE ELECTRON SOURCE HAVING AN EXTRACTOR GRID

TECHNICAL FIELD

The present invention relates to a photo-cathode electron source for a flat panel display device.

BACKGROUND ART

Electron sources are particularly although not exclusively useful in display applications, especially flat panel display applications. Such applications include television receivers and visual display units for computers, especially although not exclusively portable computers, personal organisers, communications equipment, and the like. Flat panel display devices based on a magnetic matrix electron source of the present invention will hereinafter by referred to as Magnetic Matrix Displays.

UK Patent Application 2304981 discloses a magnetic matrix display having a cathode for emitting electrons, a permanent magnet with a two dimensional array of channels extending between opposite poles of the magnet, the direction of magnetisation being from the surface facing the cathode to the opposing surface. The magnet generates, in each channel, a magnetic field for forming electrons from the cathode means into an electron beam. The display also has a screen for receiving an electron beam from each channel. The screen has a phosphor coating facing the side of the magnet remote from the cathode, the phosphor coating comprising a plurality of stripes per column, each stripe corresponding to a different channel. Flat panel display devices based on a magnetic matrix will hereinafter by referred to as Magnetic Matrix Displays.

The permanent magnet in a magnetic matrix display cannot be operated at the normal thermionic cathode temperature (993K) because this is beyond the Curie temperature—the point at which the magnet loses its magnetism properties. Methods for reflecting the majority of the thermionic cathode heat from the magnet have been previously disclosed, as have methods of heatsinking the magnet. However, it would be desirable if the cathode did not produce heat that needs to be either reflected and dissipated or dissipated by heatsinking.

Non-thermionic cathodes (i.e. so-called "cold" cathodes) are available. Examples are Metal-Insulator-Metal (MIM) cathodes, microtips and many others. However, these cathodes are all field emission types, characterised by the need for a strong electric field in the vicinity of the cathode material to pull electrons free from the cathode surface into the vacuum above the cathode. Two important characteristics of these cathodes make their use in a magnetic matrix display difficult:

1. The released electrons have a high eV. High electron energies will lead to the need for high Grid 1 voltages to ensure adequate differentiation between the "cut-off" and "non-select" levels. To obtain this, high voltage Gl drivers will be required, which are more costly than their low voltage counterparts.
2. A very good vacuum is needed to prolong cathode life.

A third type of cathode—the photo-cathode—is known and can be used in this application. Electron emission from these is based on the photoelectric effect, that is, photons with sufficiently short wavelength (sufficiently high energy) can "knock" electrons free from the cathode material. Photo-cathodes are well known, being used for many decades in devices such as image intensifiers, film audio processing and the like.

Photo-cathodes fall into two categories—those lit from the front, and those lit from the rear. For magnetic matrix displays applications, a backlit photocathode is preferred. A preferred light source is the fluorescent tubes used in LCD backlights, with the lamp colour set to the point of maximum cathode efficiency. In order to obtain high (quantum) efficiency, at least one of the photo-cathode materials is picked to have a low work function e.g. Caesium (Cs) @ 1.4 V. Whilst this increases the quantum yield, the cathode surface is highly reactive and this makes fabrication of the cathode difficult for cases where it is fabricated in other than its place of use. For example, in a photomultiplier tube (PMT), the cathode materials are deposited on a wire filament. Once the PMT has been fabricated and evacuated, only then is the filament "fired" to deposit the cathode material on the inside of the top glass face of the tube. Typically the distance between the filament and working face of the tube is of the order of a few tens of mm.

Conventional methods of vapour deposition of a photo-cathode have relied on a small coil or coils disposed around the periphery of the active cathode area. The cathode material is deposited by heating these coils to evaporate off the photo-cathode materials placed on them during manufacture. In a magnetic matrix display, these coils cannot be in the active display area and thus they need to be placed around the periphery of the display area. This means that there is a substantial difference in distance between the coil to backplate distance at the edge of the display when compared with the coil to backplate distance at the centre of the display. Thus evaporation of the photo-cathode material across the desired cathode area will be highly nonuniform.

In the cathode region of a magnetic matrix display, space between the back plate of the display and the magnet assembly is limited. This means that conventional photo-cathode deposition techniques using a plurality of heater filaments cannot be applied whilst retaining a uniform layer of photoemissive materials. In view of the manufacturing difficulties associated with storing extremely reactive photo-cathodes, less reactive cathode materials may be used, but with lower quantum efficiency or reduced spectral response. An example of such a cathode system was described in Information Display magazine, August 1997—Vol. 13, No. 8. The energy of electrons emitted from a photo-cathode is nominally the difference between the photon's energy which causes the emission and the work function of the cathode material i.e. the energy the electron loses in escaping from the lattice. This is usually quite low, limited to a few eVs at most, and typically a few tenths of an eV. This makes the photo-cathode a preferred choice because of the low Grid 1 voltage which needs to be employed to hold inactive pixels at the "non-select" level when compared to active pixels at the "cut-off" level.

At least two of the problems which must be addressed for use of a photo-cathode in a magnetic matrix display are that it must be sufficiently efficient so as to reduce the overall power consumed by the display and that it must provide the required uniformity of emission.

DISCLOSURE OF INVENTION

Accordingly the invention provides an electron source comprising: photo-cathode means for emitting electrons on excitation by incident light radiation; and extractor grid means maintained, in use, at a positive potential with respect to the photo-cathode means. The use of a photo-cathode means that the electron source does not generate the high temperatures that a thermionic cathode generates. The use of an extractor grid means that the distance between the physical cathode and the virtual cathode from where electrons appear to be emitted is many times greater than for a normal cathode without an extractor grid. This means that any cathode "structure" causing non-uniform emission tends to be blurred.

Preferably, the extractor grid means is used as a carrier for unfired photoemissive material which forms the emission surface of the photo-cathode. In a preferred embodiment, the photoemissive material is deposited on the surface to form the photo-cathode means by means of evaporation from the extractor grid means. This enables the photoemissive material to be deposited in a uniform layer and so achieve uniformity of emission.

Preferably, the extractor grid means is used as the means of "catching" unwanted electron emission when the display is operating. This means that any emission from photoemissive material scattered to other parts of the display does not interfere with the desired display operation.

In a preferred embodiment, the electron source further comprises a plurality of control grid means for controlling a flow of electrons from the photo-cathode means into channels formed in a magnet.

Also, in a preferred embodiment, the electron source further comprises a segmented backlight, each of the segments being activated just prior to the time when the region of the cathode surface over which they provide light is required to produce electrons and being deactivated after said requirement has passed. This has the advantage that the total power required by the backlight system is reduced or that the peak light power applied to an individual segment may be increased.

The present invention extends to a display device comprising: an electron source as hereinbefore described; a permanent magnet perforated by a plurality of channels extending between opposite poles of the magnet, the magnet generating, in each channel, a magnetic field which forms electrons received from the photo-cathode means into an electron beam for guidance towards a target; a screen for receiving electrons from the electron source, the screen having a phosphor coating facing the side of the magnet remote from the electron source; grid electrode means disposed between the electron source and the magnet for controlling flow of electrons from the electron source into each channel; anode means disposed on the surface of the magnet remote from the electron source for accelerating electrons through the channels; and means for supplying control signals to the grid electrode means and the anode means to selectively control flow of electrons from the electron source to the phosphor coating via the channels thereby to produce an image on the screen. The use of a magnet as a collimator for forming electrons into an electron beam is particularly advantageous with the present invention since, with a thermionic cathode, measures have to be taken to reflect or to heatsink the heat generated away from the magnet. With the present invention, the heat generated is considerably lower and so such measures are unnecessary.

The present invention further extends to a computer system comprising: memory means; data transfer means for transferring data to and from the memory means; processor means for processing data stored in the memory means; and a display device as hereinbefore described for displaying data processed by the processor means.

BRIEF DESCRIPTION OF DRAWINGS

Embodiments of the invention will now be described, by way of example only, with reference to the accompanying drawings, in which.

DETAILED DESCRIPTION OF THE INVENTION

An important parameter in cathode design is the uniformity of emission which is achieved by a cathode. For displays such as magnetic matrix displays that make use of an area cathode, irregularities in emission over the surface of the area cathode manifest themselves as variations in the luminance of the display over the active display area. If such irregularities exist, then steps must be taken to minimise or eliminate these irregularities.

The use of an extractor grid is one such method of minimising or eliminating these irregularities. Electron emission from a photo-cathode surface is predominantly normal to the lattice structure of the photo-cathode material. However, the surface of the photo-cathode material is atomically rough and therefore the orientation of the lattice is effectively random. This means that electrons emerging from the photo-cathode do so in a random manner, being described as a first approximation as emission from a hemisphere at every point of the surface of the photo-cathode.

Figure 1:
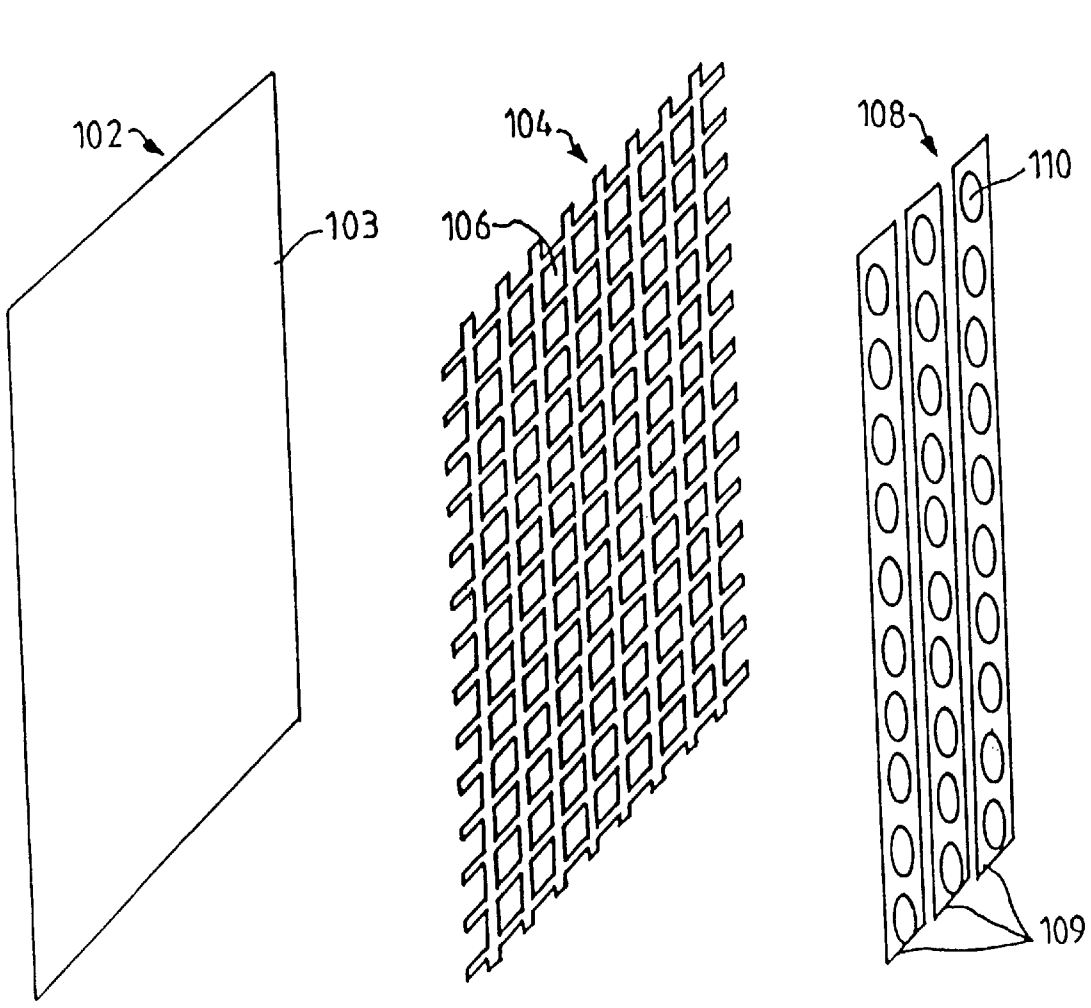
FIG. 1 is a schematic diagram of a photo-cathode and extractor grid used in a magnetic matrix display.

FIG. 1 shows photo-cathode 100 according to the present invention. The photo-cathode substrate 102 has a photo-cathode 103 deposited on a surface facing an extractor grid 104 having apertures 106. Also shown in FIG. 1 are control grids 108 in the form of stripes 109, having an aperture 110 corresponding to each pixel of the display. In operation of the display, the photo-cathode 103 is held at 0 volts potential, the extractor grid 104 is at a positive potential and the control grid 108 is held at a negative potential. Because the extractor grid 104 is at a positive potential with respect to the cathode, then regardless of the initial direction of the emitted electrons, they are rapidly accelerated towards the extractor grid 104. Given that the initial energy of the electron is low (a few eV at most), and that the extractor grid 104 is at a potential of a few tens of volts, to a first approximation, the electrons may be considered to meet the extractor grid 104 with a normal angle of incidence. Thus the extractor grid's 104 transmission is approximately the ratio of the "open" area to the total area. This figure is typically greater than 80% and so more than 80% of electrons pass through the grid.

A benefit of the use of an extractor grid 104 is that the distance between the physical cathode and the virtual cathode from where electrons appear to be emitted is many times greater with an extractor grid 104 than for a normal cathode without an extractor grid 104. With the use of an extractor grid 104, the separation may be several mm. Without an extractor grid 104, the separation is typically less than 50 $\mu$m. This increased separation means that the electron's lateral component of motion across the cathode surface now has a bearing on overall cathode uniformity since any cathode "structure" leading to non-uniformities of emission tends to be blurred. The magnetic field from the magnet in a magnetic matrix display also further modifies electron trajectories, especially at the virtual cathode where the magnetic field is strongest and the electrons have the lowest velocity normal to the plane of the virtual cathode surface.

Figure 2:
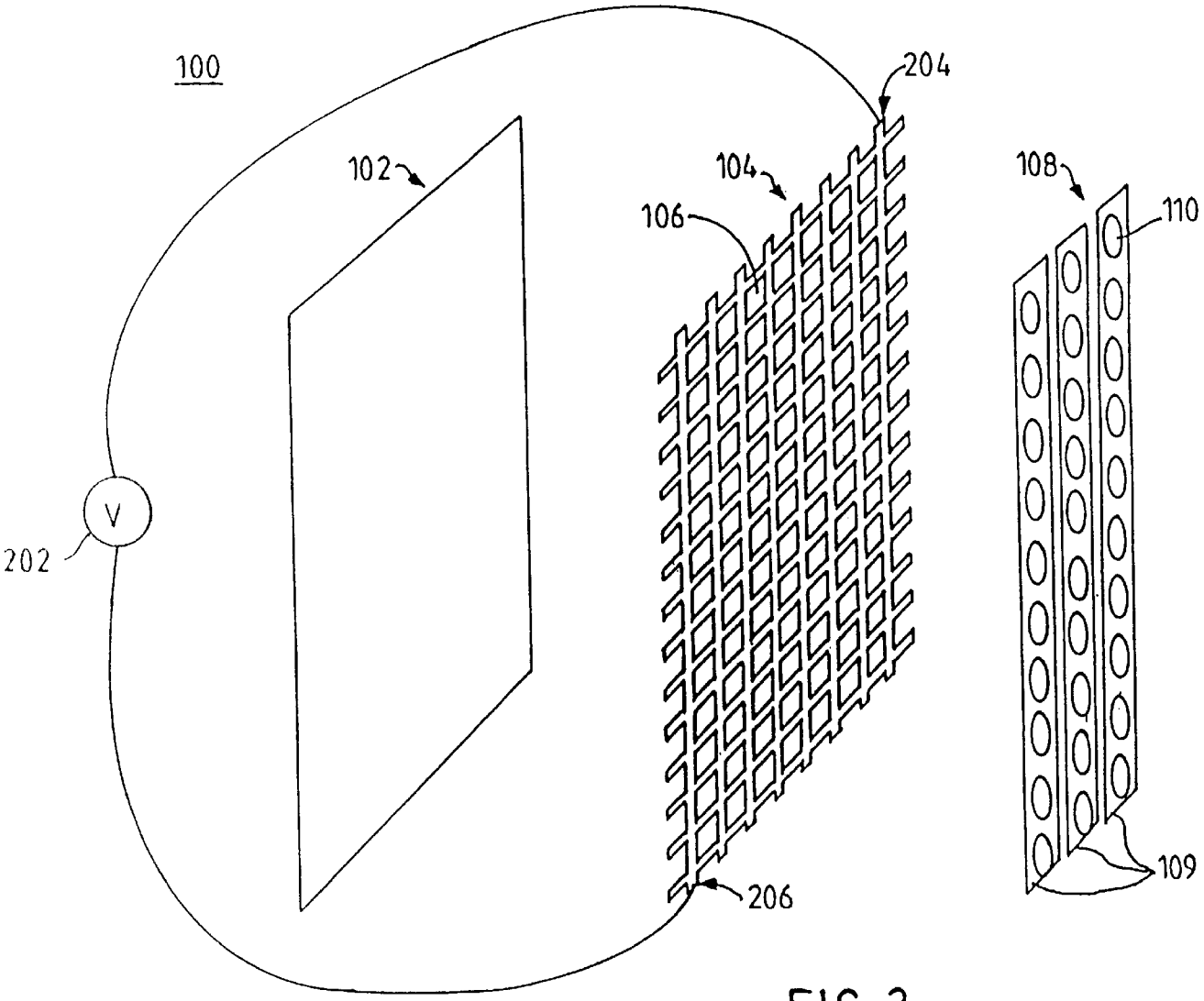
FIG. 2 shows the photo-cathode and extractor grid of FIG. 1 with the extractor grid used as a heating element.

Prior to assembly, the surfaces of the extractor grid 104 facing the rear of the display are coated with a photoemissive material. Referring to FIG. 2, once assembly is complete and the display envelope has been evacuated, a current is then passed through the extractor grid 104, causing it to heat up, evaporate the photoemissive material from the extractor grid 104 and deposit the photo-cathode material, preferably on the rear surface of the display. The extractor grid 104 may be heated by applying a voltage from a power source 202 by means of connections 204, 206 to the extractor grid 104. A current then flows through the extractor grid 104, causing it to heat up. Photoemissive material will then be evaporated from the extractor grid 104 and deposited onto the surface of the photocathode 103 on the substrate 102. The extractor grid 104 has the same aperture structure as the magnet of a magnetic matrix display and so, even though there may be non-uniformities in deposition across the area of a single pixel, all pixels should be equally affected, therefore the overall display uniformity is preserved. FIG. 2 shows a conceptual process in which there is no control of the uniformity of heating of the extractor grid. Prior art methods for controlling the uniformity of heating of a grid element would, in practice be used, but have not been included in FIG. 2 for clarity. If the extractor grid 104 is not uniformly heated, then the resulting deposition of photoemissive material will not be uniform.

Multiple layers of material may be evaporated from the extractor grid 104 by causing different levels of current to flow through the extractor grid 104 and so creating different temperatures. This technique takes advantage of the fact that different materials deposited on the extractor grid 104 evaporate at different temperatures.

Figure 3:
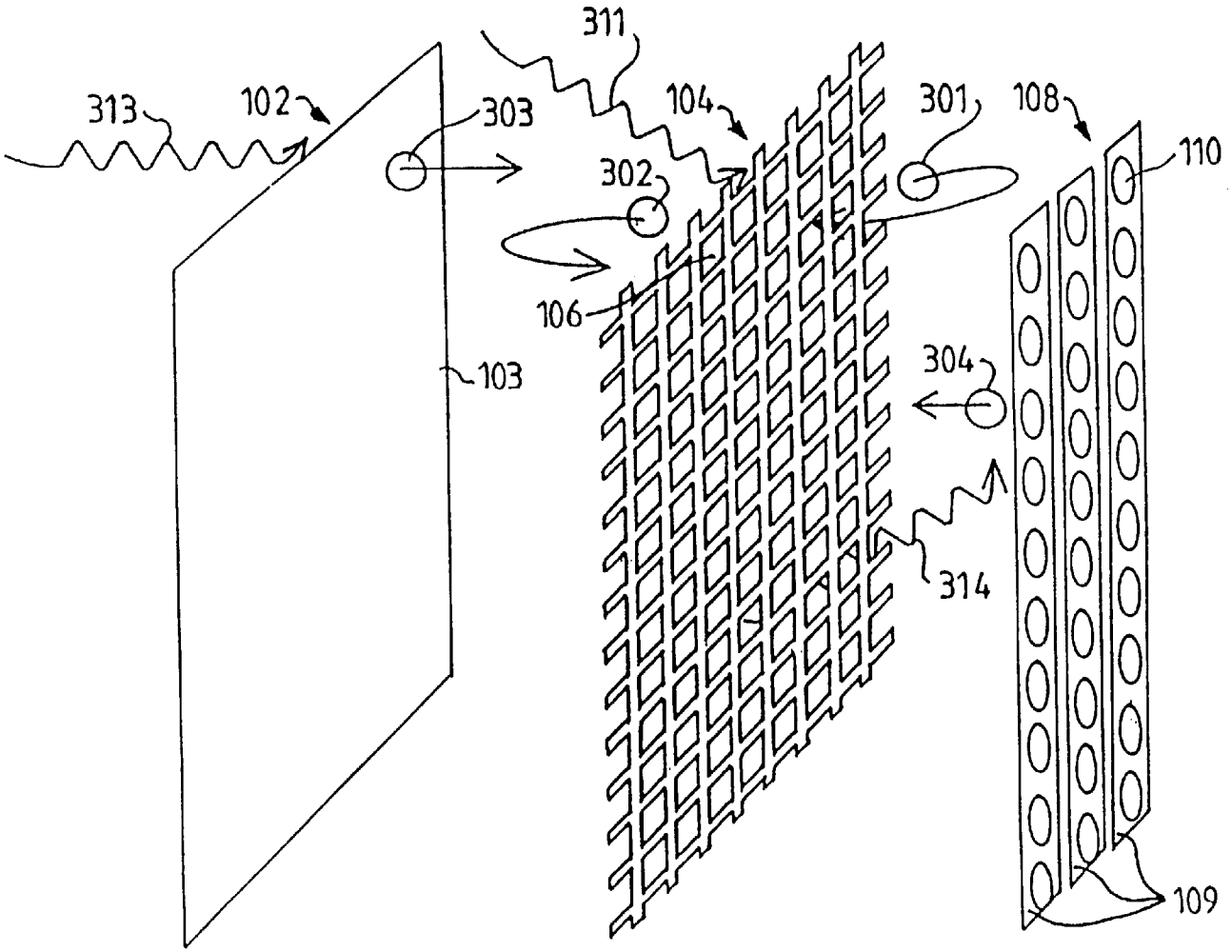
FIG. 3 shows the extractor grid of FIG. 1 being used to collect unwanted electron emission.

There will be some scattering of evaporated photocathode material to other parts of the display, which will themselves become photoemissive. Referring to FIG. 3, the tracks of four electrons are shown, the electrons having been emitted 303 from the photo-cathode 102, either side 301, 302 of the extractor grid 104 and 304 from the control grid 108. The extractor grid 104 performs the function of collecting stray electron 301, 302, 304 emission so that these electrons do not interfere with the desired operation of the display.

A backlit photo-cathode does not absorb 100% of the incident light. Some of the light intended for the photocathode will strike other internal parts of the display. This light will be in the visible region and hence photoemission from the other internal parts of the display, such as the magnet assembly materials is unexpected. However, the reactive materials used on the extractor grid 104 will, during firing, scatter to unwanted parts of the display system behind the magnet and hence become photosensitive.

FIG. 3 shows photons 311, 314 which strike the extractor grid 104 and magnet after passing through the photo-cathode 102. The presence of the positive voltage on the extractor grid 104 will cause all electrons emitted as a result of the photons to be attracted towards the extractor grid 104.

Taking the example of an electron 304 released from the control grid 108; assume that the control grid 108 is at a non-select potential of −6V, the extractor grid 104 is at a potential of +20V and the photo-cathode 102 is at a potential of 0V. An electron which leaves the control grid 108 with an energy of 1 ev will accelerate towards the extractor grid 104 and either pass through the mesh of the extractor grid 104 or will collide with the mesh of the extractor grid 104 and be absorbed into the extractor grid 104 and no longer be a free electron. In the case where the electron passes through the extractor grid 104, it will collide with the cathode before the repelling field from the cathode slows it sufficiently. This is because it has an energy of 7ev more than the cathode potential.

Similarly for an electron 301, 302 released from the extractor grid 104, again with an energy of 1eV. The extractor grid 104 has a potential of 20V w.r.t. the cathode and 26V w.r.t. the non-select levels on the control grid 108. Thus the electron will pursue an oscillatory path in the region of the extractor grid 104 until it collides with the grid and is "lost".

The extractor grid 104 will tend to form a local cloud of electrons about it due to this mechanism, and associated with this there will be some space charge effects. However, the bulk of the electron emission will be directly from the photo-cathode 102. When these electrons 303 pass through the extractor grid 104 their velocity is high and therefore they have a low charge density and so their contribution to the space charge effects in the vicinity of the extractor grid 104 is low. The net effect is that the electrons will not reach as high a velocity as might be expected.

It is well known that materials which make good photocathodes also make good secondary emitters. As discussed above, an appreciable percentage of the electrons released from the photo-cathode 102 will collide with the extractor grid 104. However, for efficient secondary electron production, the incident electrons would need to have energies of a few hundred eVs. The low voltage of the extractor grid 104 means that few, if any, secondary electrons are anticipated. If any are produced, like those released by the photoelectric effect from the cathode material covering the extractor grid 104, they will stay in very close proximity to the extractor grid 104 due to the strong negative voltage from the photo-cathode 102 and the control grid 108 on either side.

It is conceivable that ions from the anode region may pass through the magnet apertures and collide with the photocathode 102. However, they are likely to have attained energies of a few kevs when reaching the cathode and at this energy level, do not make good sources for secondary emission. None the less, there may be a small number of highly energetic electrons released from the cathode. These will either collide with the display structure (the non-select level being too small to repel them) or pass through the apertures back to the anode, resulting in a very small change in the black level of the display. Such a change in black level will be insignificant.

The cathode power that is required for a workable display is now considered. Due to the relatively long dwell time of the electron beam on the phosphor of the display faceplate, the current requirements imposed on the cathode are modest. For 100 $Cd/m^2$ luminance on a 17" (432 mm) 1280×1024 resolution display, the current per pixel is of the order of 200 nA with an EHT voltage of 10 KV. If, say, 1024 pixels are to be simultaneously active, this equates to some 200 $\mu$A total current required from the cathode. However, the "active" area of the cathode is small compared to the total area of the cathode and the actual emission current density required is of the order of 1 $mA/cm^2$. The active area is the area over which emission contributes to instantaneous beam current. For the example display size above, and assuming an unsegmented cathode, this equates to a total emission current of about 890 mA, since the active screen area is 890 $cm^2$. This means that a little over 0.1% of the electrons produced actually contribute to the electron beam current flowing to the anode. The remainder are either absorbed by the extractor grid 104 or fall back to the photo-cathode 102.

Figure 4:
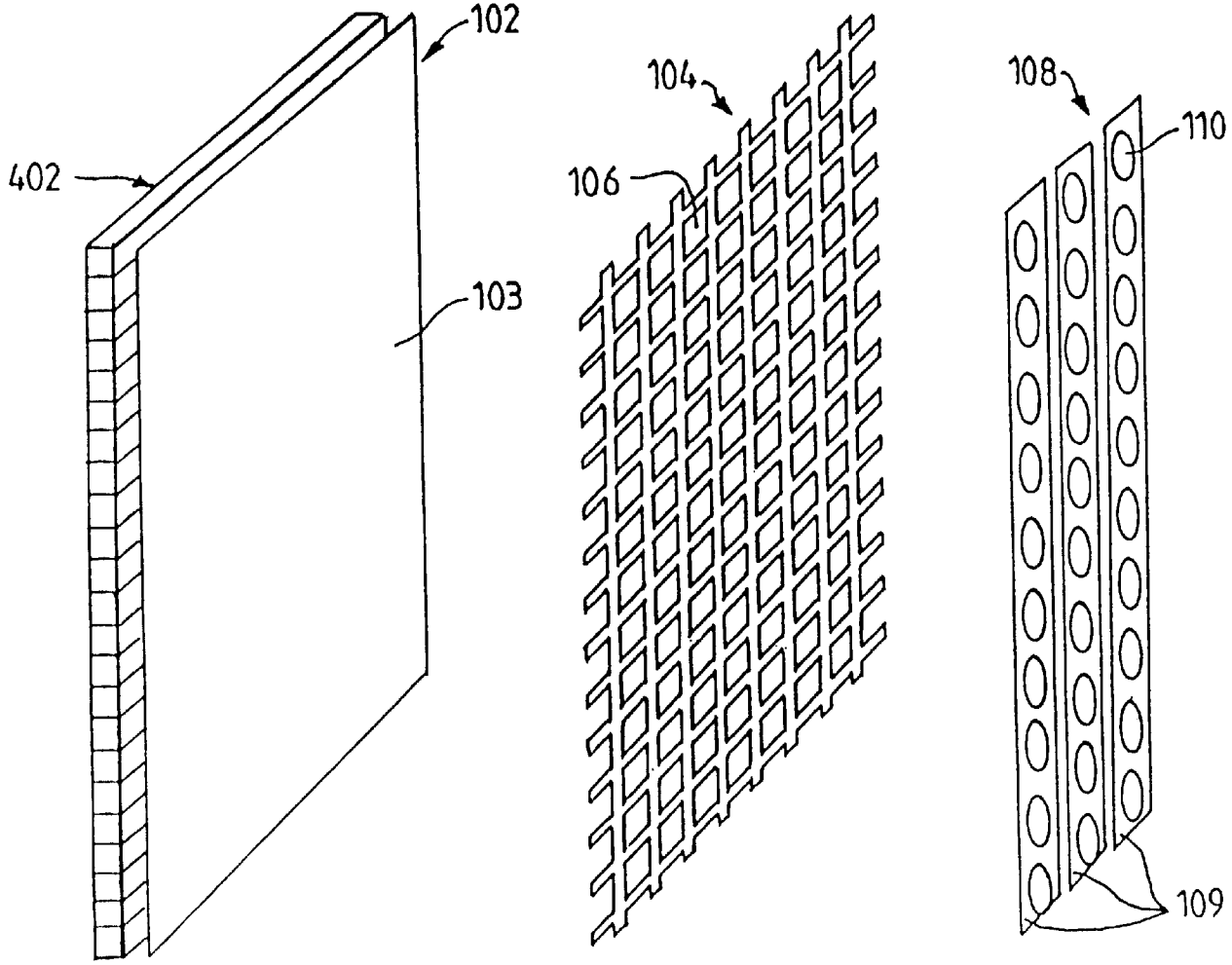
FIG. 4 shows the photo-cathode and extractor grid of FIG. 1 together with a segmented backlight.

FIG. 4 shows a preferred embodiment of the present invention, in which, instead of constantly illuminating the whole of the rear of the photo-cathode 102, a number of separate backlights 402 are employed. In operation, each backlight 402 is switched on just before the region of the photo-cathode 102 over which they provide light becomes active. Each of the backlights is switched off again after the region associated with the particular backlight has been scanned. This arrangement has the benefit of reducing the total power required by the backlight system, at the expense of an increased number of backlight components. This progressive illumination scheme is advantageously employed with a magnetic matrix display using a backlit photo-cathode.

Whilst the invention has been described with reference to a magnetic matrix display, an extractor grid according to the present invention may be used in any flat panel display which utilises a photo-cathode. A photo-cathode may be formed by depositing the material on the photo-cathode surface from the extractor grid in any photo-cathode that uses an extractor grid, regardless of the technology used for the rest of the display.

What is claimed is:

1. An electron source comprising: photo-cathode means for emitting electrons on excitation by incident light radiation; and extractor grid means maintained, in use, at a positive potential with respect to the photo-cathode means; said extractor grid means forming a carrier for unfired photo-cathode material which forms an emission surface of the; wherein the photo-cathode material is deposited on the surface to form the photo-cathode means by means of evaporation from the extractor grid means.

2. An electron source as claimed in claim 1 wherein the photo-cathode material includes Caesium.

3. An electron source as claimed in claim 1 wherein the extractor grid means is used as the means of "catching" unwanted electron emission when the electron source is in an operating mode.

4. An electron source as claimed in claim 1 further comprising a plurality of control grid means for controlling a flow of electrons from the photo-cathode means.

5. An electron source as claimed in claim 1 further comprising a segmented backlight, each of the segments being activated just prior to the time when the region of the cathode surface over which they provide light is required to produce electrons and being deactivated when said region is not required to produce electrons.

* * * * *